US008695653B2

(12) United States Patent
Bennett

(10) Patent No.: US 8,695,653 B2
(45) Date of Patent: Apr. 15, 2014

(54) COVER HAVING KNEE SUPPORT FOR USE WHEN SERVICING A TOILET

(76) Inventor: Jeffrey F. Bennett, Raleigh, NC (US)

( * ) Notice: Subject to any disclaimer, the term of this patent is extended or adjusted under 35 U.S.C. 154(b) by 246 days.

(21) Appl. No.: 13/246,296

(22) Filed: Sep. 27, 2011

(65) Prior Publication Data

US 2013/0075000 A1 Mar. 28, 2013

(51) Int. Cl.
*B65D 65/02* (2006.01)
*A47K 17/00* (2006.01)

(52) U.S. Cl.
USPC ..... 150/154; 4/253; 4/661; 4/901

(58) Field of Classification Search
USPC ..... 150/154; 4/580, 599, 561, 659, 901, 4/902, 253, 420; 297/423.1, 423.11; 46/580, 599, 661, 659, 901, 902
See application file for complete search history.

(56) References Cited

U.S. PATENT DOCUMENTS 1,793,815 A * 2/1931 McCann ..... 4/253
2,658,201 A * 11/1953 Sherwood ..... 4/661
D214,444 S * 6/1969 Weinman ..... D23/313
4,937,897 A * 7/1990 Barnabie ..... 4/580
5,313,675 A * 5/1994 Tinen ..... 4/580
5,560,049 A * 10/1996 Robinson et al. ..... 4/253
5,581,824 A * 12/1996 Crook, Sr. ..... 4/253
6,108,827 A * 8/2000 Espadas ..... 4/253
6,216,819 B1 * 4/2001 Cougar ..... 182/45
D444,551 S * 7/2001 Foster ..... D23/311
D503,970 S * 4/2005 Johnson ..... D23/311
8,011,401 B1 * 9/2011 Utterback ..... 150/154
2006/0000014 A1 * 1/2006 Mullen et al. ..... 4/661

* cited by examiner

*Primary Examiner* — Sue A Weaver

(74) *Attorney, Agent, or Firm* — NK Patent Law, PLLC

(57) ABSTRACT

A cover for a toilet is provided. The cover includes a sheet having side-facing portions that extend from a top portion and are configured to extend to a ground surface and a front-facing portion that extends from the top portion and is configured to extend to a ground surface spaced-frontwardly from the toilet. A support is carried on about a proximal end of the front-facing portion for providing support to a technician during servicing of the toilet. The support may be a cushion that is made of any appropriately configured material.

20 Claims, 8 Drawing Sheets

COVER HAVING KNEE SUPPORT FOR USE WHEN SERVICING A TOILET

TECHNICAL FIELD

This application is directed towards a cover for a toilet, and more particularly towards a cover having a knee support for use when servicing a toilet. The cover may also be configured for providing an indication of operability for a patron.

BACKGROUND

Many covers have been developed for covering a portion of a toilet. These covers have been for ornamental purposes, aimed at providing a more aesthetically pleasing appearance of the toilet, while maintaining operability and use of the toilet.

However, these covers have not been suitable for restricting use of the toilet. Nor have these covers been suitable for indicating the operability status of a toilet. For example, a technician, such as a plumber, would not have employed a conventional cover for indicating that the toilet was currently out of order and awaiting servicing because the cover was ornamental in nature and would not provide indication to a user of operability of the toilet. Furthermore, to the extent that a technician may have tried to employ a conventional cover, the cover may not have been suitable for use in a repair setting for any variety of reasons.

Accordingly, a need exists for a cover that is employable in a repair setting and capable of indicating a condition of operability to patrons.

SUMMARY

This Summary is provided to introduce a selection of concepts in a simplified form that are further described below in the Detailed Description of Illustrative Embodiments. This Summary is not intended to identify key features or essential features of the claimed subject matter, nor is it intended to be used to limit the scope of the claimed subject matter.

Disclosed herein is a cover for a toilet. The cover includes a sheet for covering the exterior surfaces of the bowl and the base of the toilet. The sheet defines a front-facing portion that extends from the bowl to a nearby floor surface. The cover includes a cushion carried on about a proximal end of the front-facing portion of the sheet for providing cushioning support to a technician during servicing of the toilet.

According to one or more embodiments, the cover includes anti-slip material on a floor-engaging portion of the sheet for reducing slip of the cover during use.

According to one or more embodiments, the cover includes a strap that extends from opposing surfaces of the sheet and around a back-facing portion of the bowl for fixedly engaging the cover to the toilet.

According to one or more embodiments, the sheet is water-impermeable.

According to one or more embodiments, the sheet is flexible.

According to one or more embodiments, the cover includes indicia on a portion of the cover. The indicia is for providing an indication of the operability of the toilet or for providing advertisement-related indicia.

According to one or more embodiments, the cover includes a pocket on an upward-facing portion thereof configured for receiving a sheet having indicia printed thereon for providing an indication of the operability of the toilet.

According to one or more embodiments, the cushion includes one of plastic, cotton, granular material, and combinations thereof According to one or more embodiments, a cover for a toilet is provided. The cover includes a sheet having side-facing portions that extend from a top portion and are configured to extend to a ground surface for covering the bowl and base of the toilet, and a front-facing portion that extends from the top portion and is configured to extend to a ground surface spaced-frontwardly from the toilet. The cover includes a support carried on about a proximal end of the front-facing portion for providing support to a technician during servicing of the toilet.

According to one or more embodiments, a cover for a toilet having a bowl and a base is provided. The cover includes a sheet having side-facing portions that extend from a top portion and are configured to extend to a ground surface for covering the bowl and base of the toilet. The sheet includes a front-facing portion not in attachment with either of the side-facing portions that extends from the top portion and is configured to extend to a ground surface spaced-frontwardly from the toilet. The cover includes a support defined on about a proximal end of the front-facing portion for providing support to a technician during servicing of the toilet. Placement of the support is adjustable by extension or retraction of the front-facing portion.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the presently disclosed invention is not limited to the specific methods and instrumentalities disclosed. In the drawings.

DETAILED DESCRIPTION

The presently disclosed invention is described with specificity to meet statutory requirements. However, the description itself is not intended to limit the scope of this patent. Rather, the inventors have contemplated that the claimed invention might also be embodied in other ways, to include different steps or elements similar to the ones described in this document, in conjunction with other present or future technologies.

Figure 1:
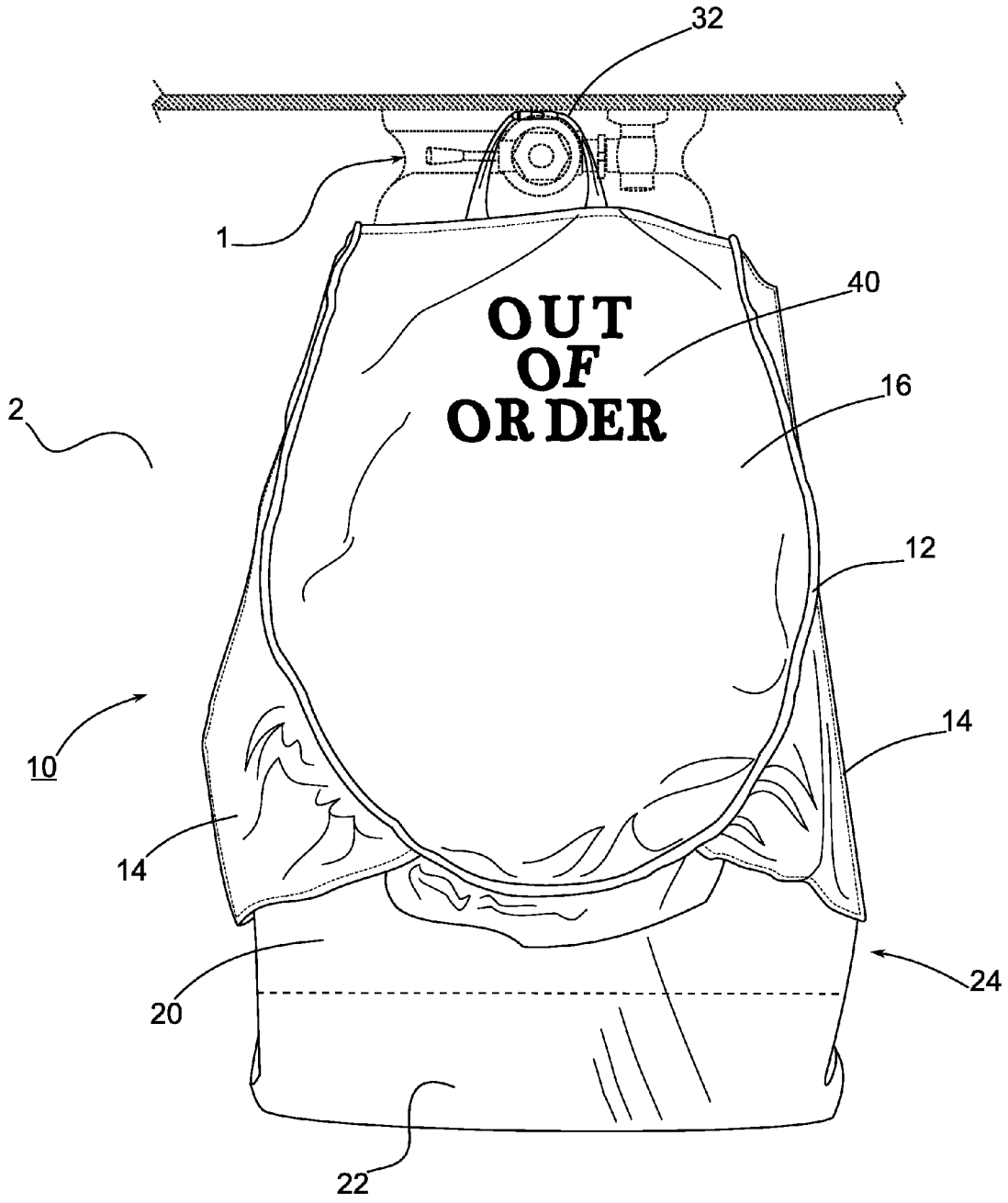
FIG. 1 illustrates a top view of a cover installed on a toilet according to one or more embodiments disclosed herein.
Figure 2:
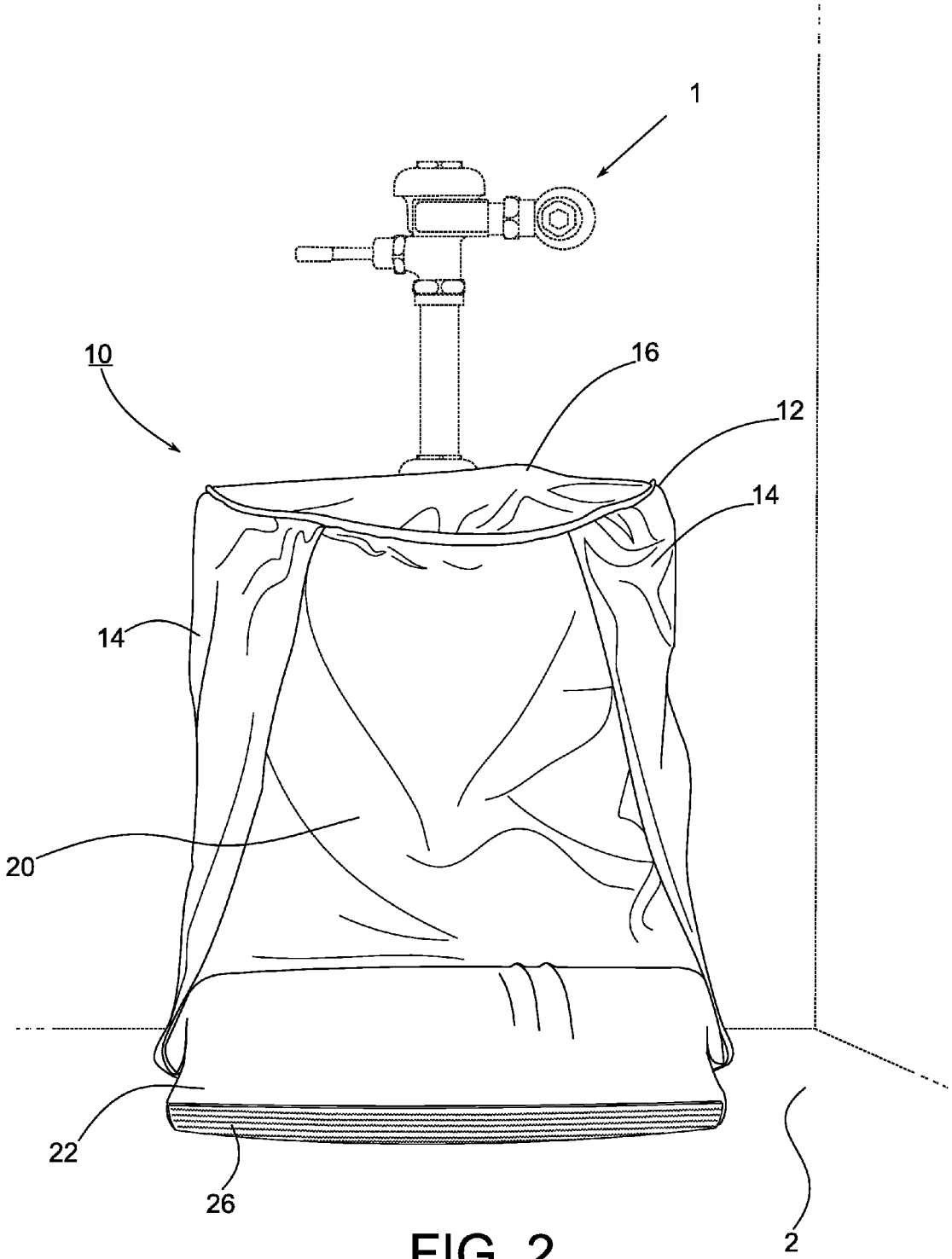
FIG. 2 illustrates a front view of a cover installed on a toilet according to one or more embodiments disclosed herein.

A cover for a toilet according to one or more embodiments is illustrated in FIG. 1, in which the cover is generally designated 10 and the toilet is generally designated 1. The toilet 1 may include a bowl 4 and a base 5. The cover 10 includes a sheet 12. The sheet 12 has side-facing portions 14 that extend from a top portion 16. The side-facing portions 14 are configured to extend to a ground surface 2 for covering the base of the toilet 1. The top portion 16 is configured for covering the upward portion of the bowl of the toilet 1. The cover 10 includes a front-facing portion 20 that extends from the top portion 16 and is configured to extend to a ground surface spaced-frontwardly from the toilet 1.

The cover 10 includes a support 22 that is carried on about a proximal end 24 of the front-facing portion 20 for providing support to a technician during servicing of the toilet. The support 22 may be advantageously provided for offering support to a technician's knees during servicing. In one or more embodiments, the front-facing portion 20 is not attached along a length thereof to each of the side-facing portions 14 and the front-facing portion 20 has significant length such that the technician can pull the front-facing portion 20 away from the toilet 1 without also pulling the cover 10 off of the toilet 1 until all of the length of the front-facing portion 20 had been employed. This represents a significant advantage over any covers that may have been developed in which a front-facing facing portion and any side-facing portions may have been attached to each other.

The support 22 may be a cushion made from any suitable material including plastic, cotton, granular materials, combinations thereof, and the like. The support 22 may extend across an entire width of the front-facing portion 20 or may extend about selected segments thereof. The support 22 may be formed from a double loop of material that is folded over as illustrated in FIG. 3, or may take on any appropriately configured shape.

The front-facing panel 20 may further include anti-slip material 26 on a floor-engaging portion 30 of the sheet 12 for reducing slippage of the cover 10 during use. The anti-slip material 26 may be any appropriately configured material, including polymer based materials having a sufficient coefficient of friction.

Figure 3:
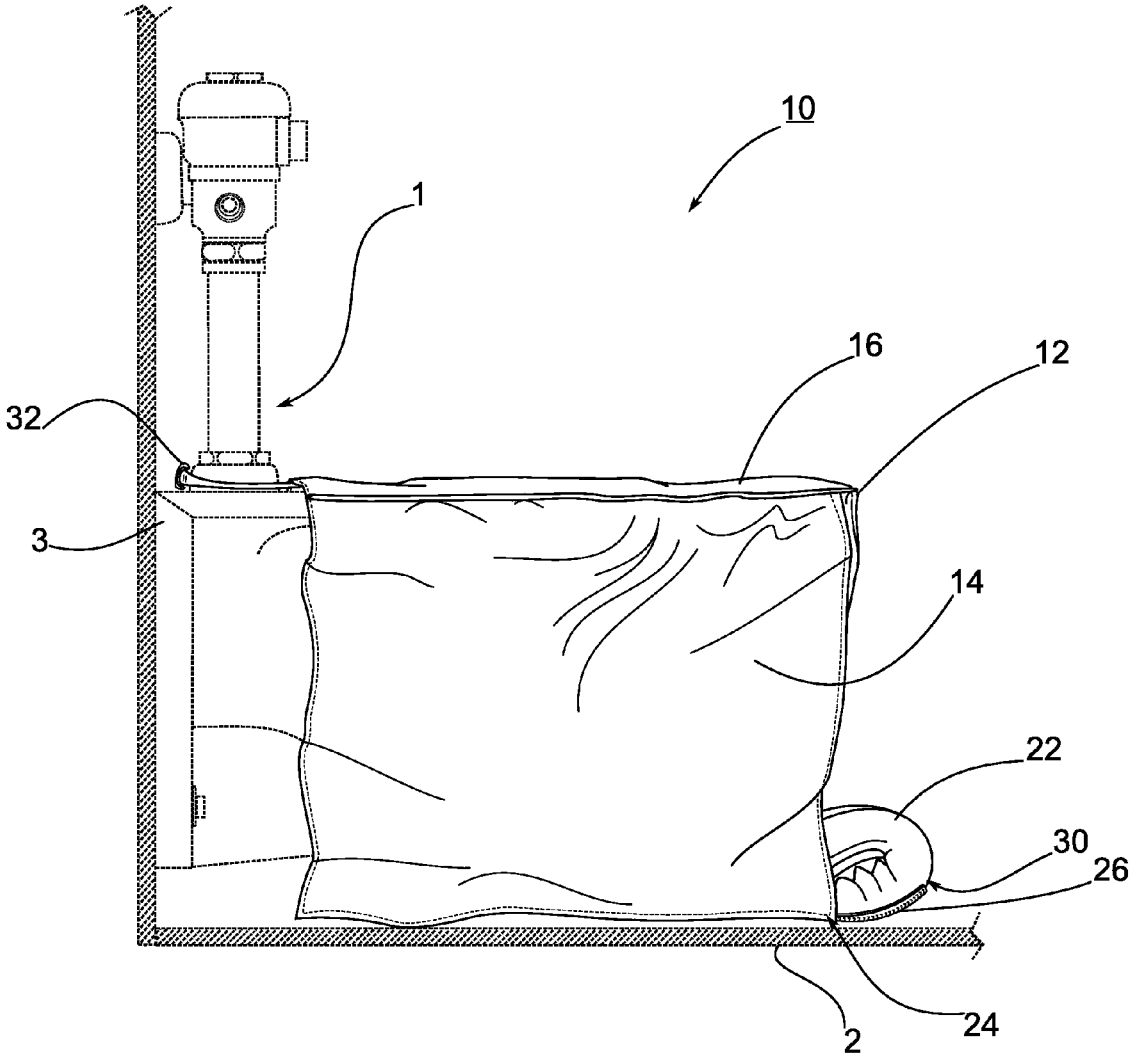
FIG. 3 illustrates a right side view of a cover installed on a toilet according to one or more embodiments disclosed herein.
Figure 4:
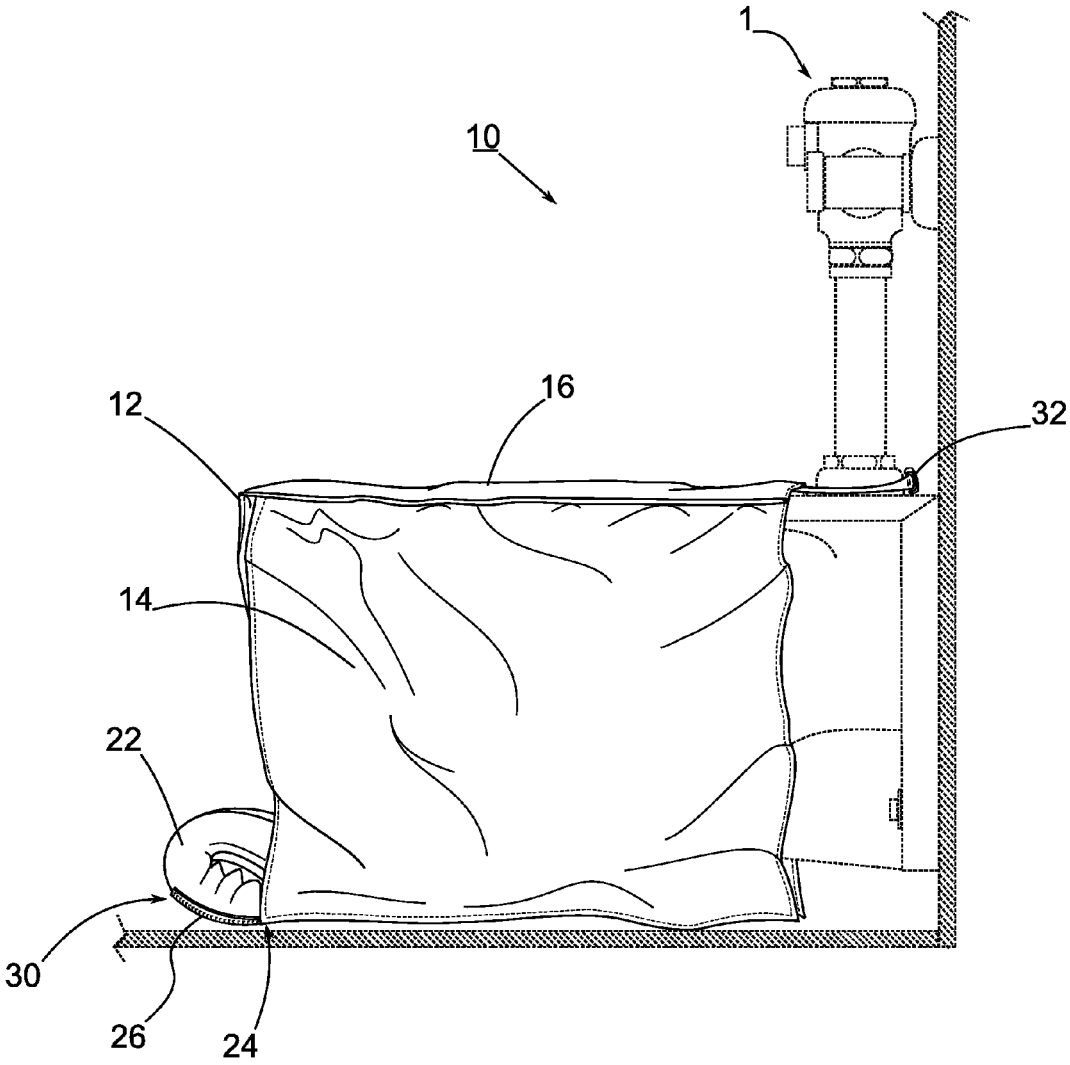
FIG. 4 illustrates a left side view of a cover installed on a toilet according to one or more embodiments disclosed herein.
Figure 5:
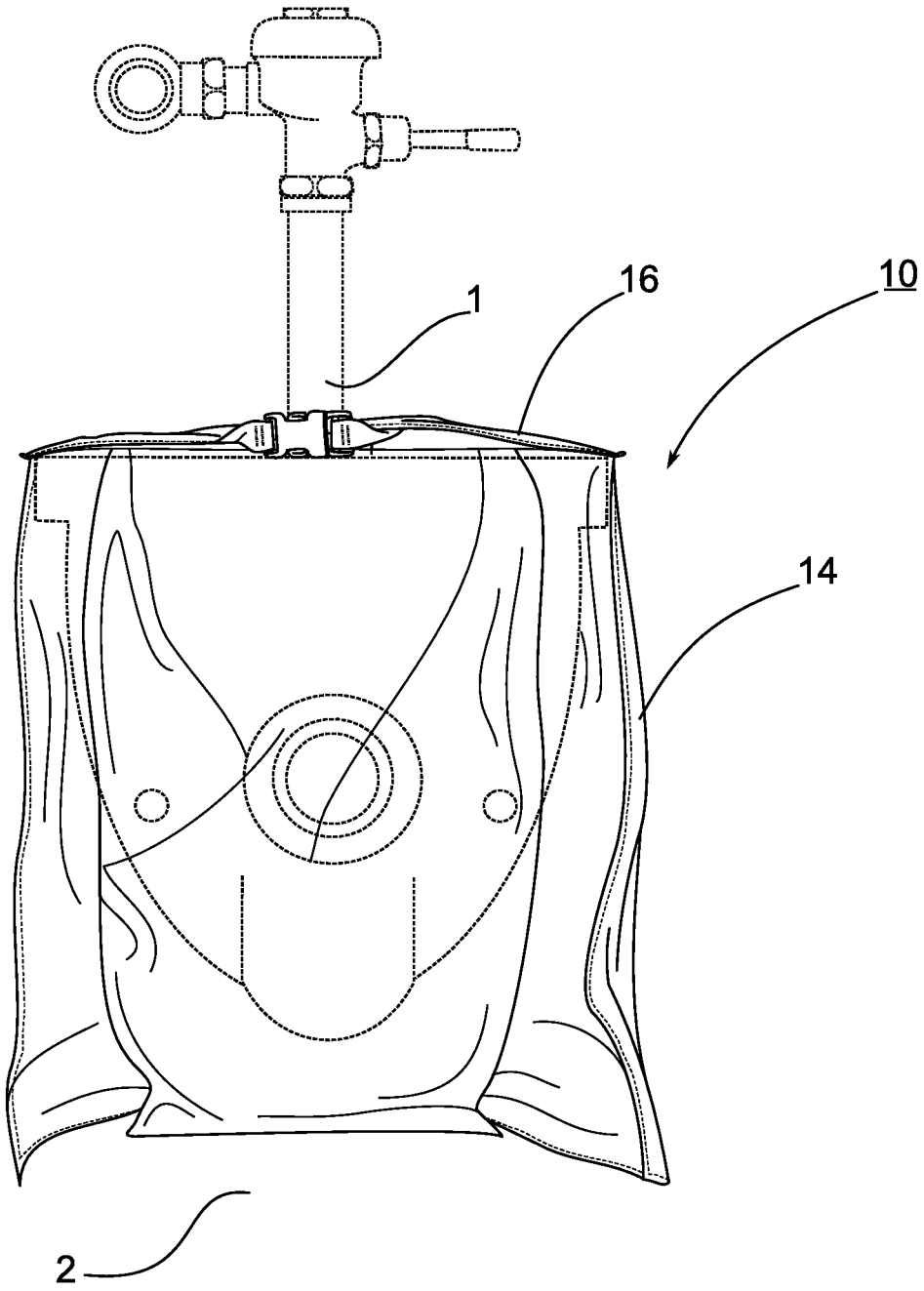
FIG. 5 illustrates a rear view of a cover installed on a toilet according to one or more embodiments disclosed herein.

As illustrated in FIG. 3, the cover 10 may also include a strap 32 that extends from each of either the side-facing portions 14 or opposing surfaces of the sheet 12 and around a back-facing portion 3 of the toilet 1 for fixedly engaging the cover 10 to the toilet 1. The strap 32 may include one or more hook and loop fasteners for securing respective end portions of the strap 32, or, alternatively, may employ clips or other similar devices for securing the strap 32. Additional straps may be provided on other portions of the cover 10 for providing further securing measures of the cover 10 to the toilet 1.

According to one or more embodiments, the sheet 12 may be water-impermeable. According to one or more additional embodiments, the sheet 12 may be flexible. The sheet 12 may be made from any number of appropriately configured materials.

As illustrated in FIG. 1, the cover 10 may further include indicia 40 on a portion thereof. The indicia 40 is configured for providing an indication of the operability of the toilet as illustrated in which the words "OUT OF ORDER" are depicted. Alternatively, the indicia 40 may be an advertisement-related indicia, including an advertisement for the technician or an advertisement for the establishment in which the cover 10 is being installed.

Figure 6:
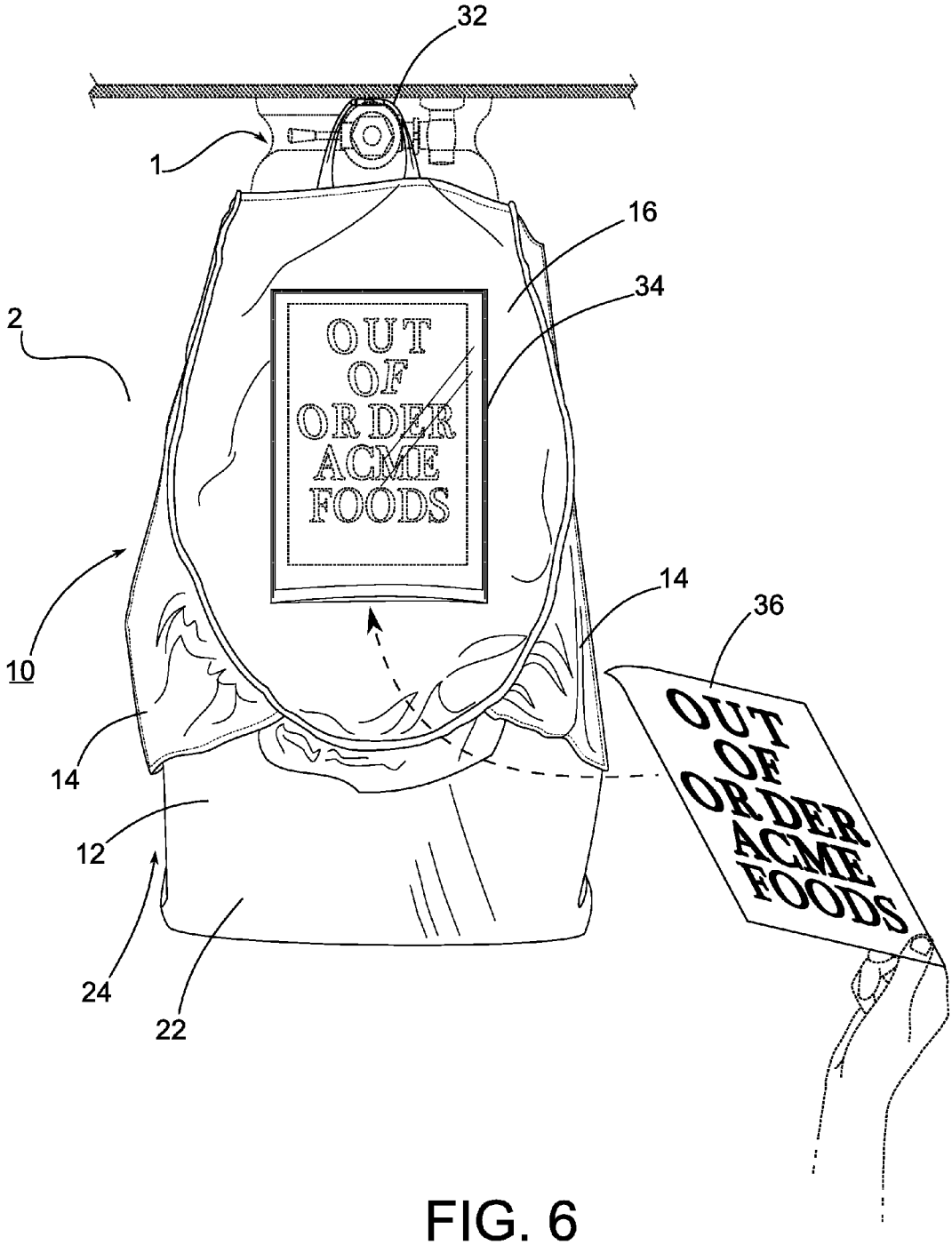
FIG. 6 illustrates a top view of a cover installed on a toilet according to one or more embodiments disclosed herein.

An alternate embodiment of a cover is illustrated in FIG. 6 in which a pocket 34 is provided on the top portion 16 of the cover 10. The pocket 34 defines a volume therein that is configured for receiving a printed indicia 36. The printed indicia 36 may be for providing an indication of operability of the toilet 1 or for advertisement-related matters. In this manner, the printed indicia 36 can be replaced for each use of the cover 10 with an appropriate selected indicia. For example, if the technician desires to indicate the service date of the toilet 1, the technician would prepare a printed indicia 36 that may have the date, time, and other relevant information related to the service call printed thereon.

Figure 7A:
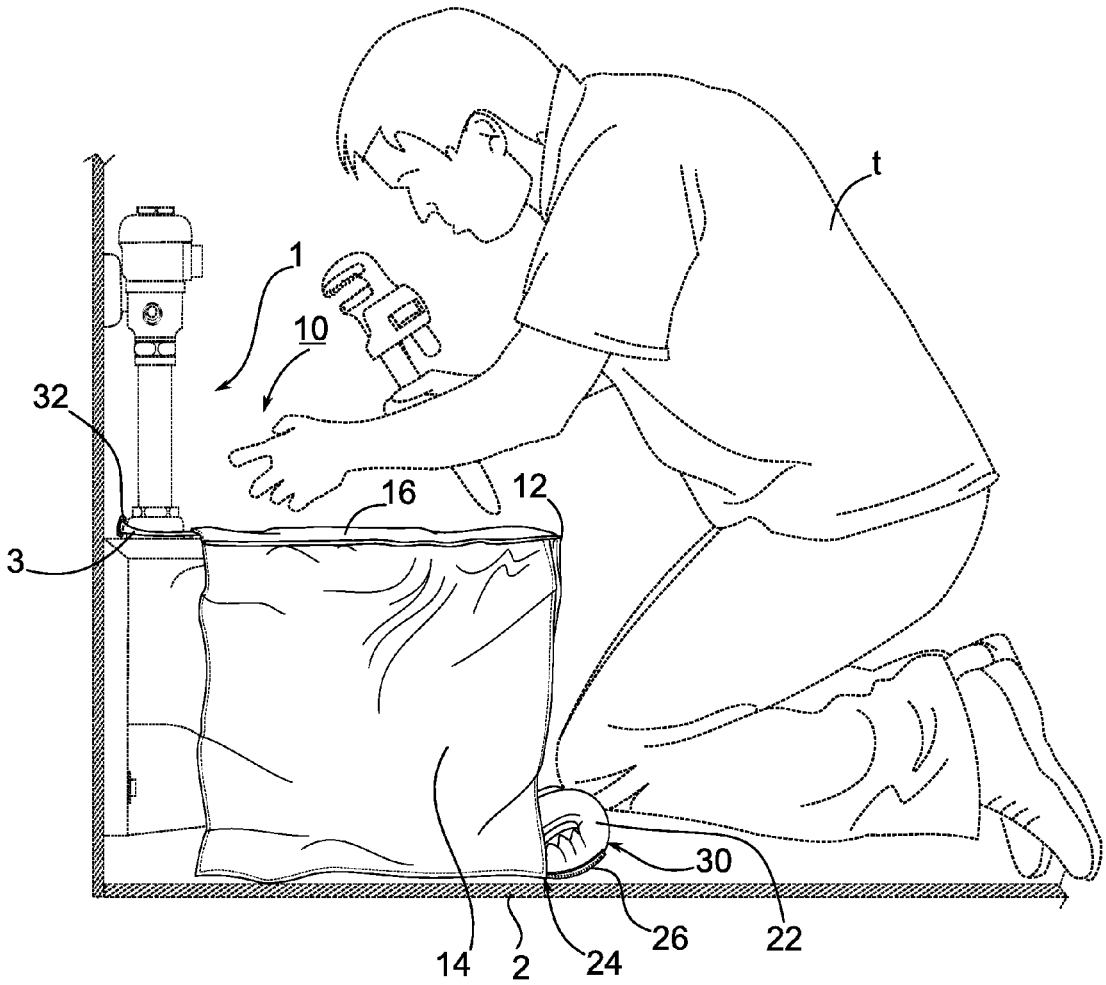
FIG. 7A illustrates a side view of a cover installed on a toilet and a technician placing a support of the cover in a closer-to position relative to the toilet.
Figure 7B:
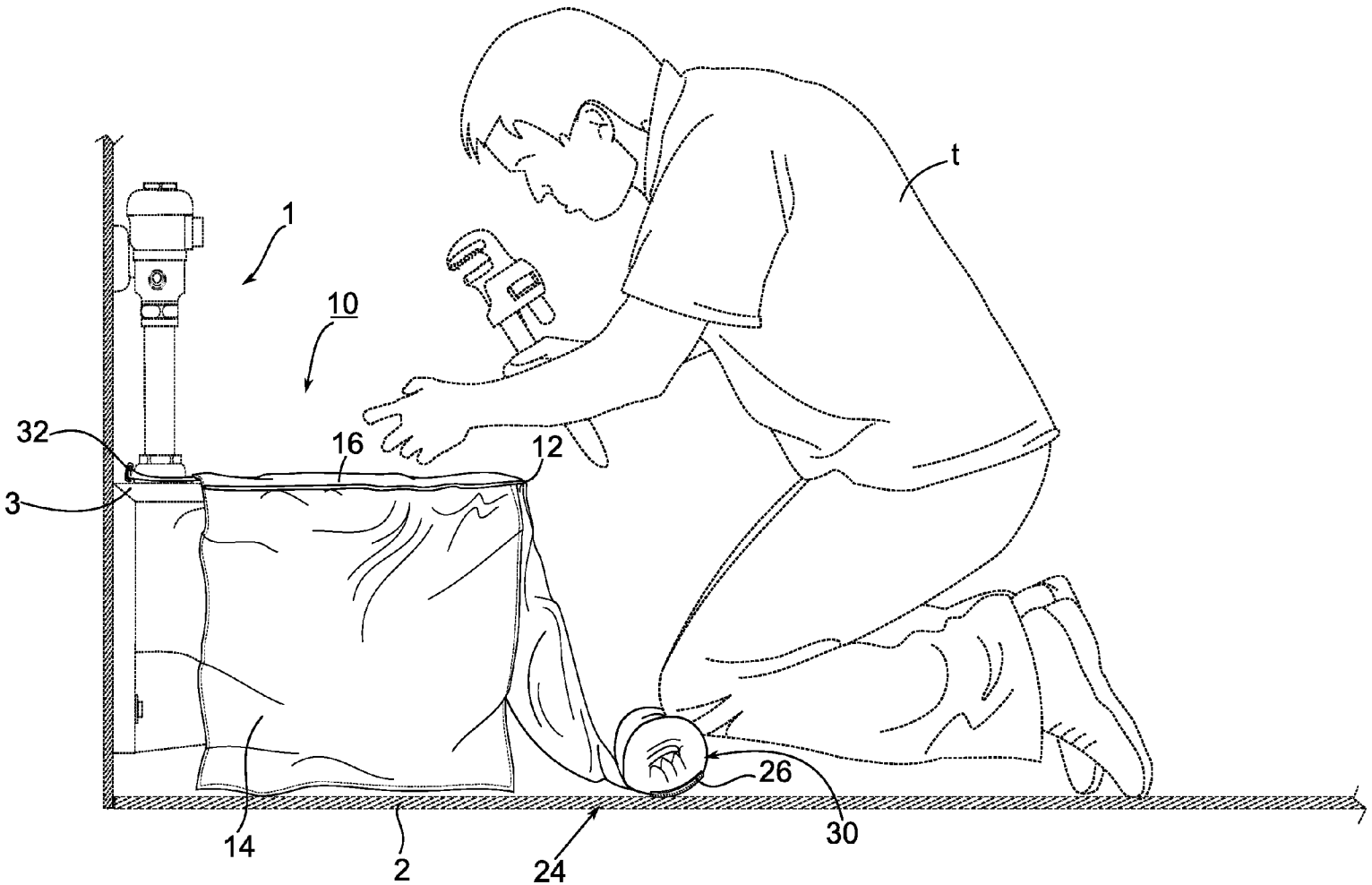
FIG. 7B illustrates a side view of a cover installed on a toilet and a technician placing a support of the cover in a farther-from position relative to the toilet.

As illustrated in each of FIGS. 7A and 7B, the front-facing portion 20 is extendable and selectively positionable relative to the toilet 1. In this manner, the front-facing portion 20 can be manipulated closer-to or farther-from the toilet 1 in order to accommodate a desired location of the support 22 by the technician "t." For example, in FIG. 7A, the technician "t" has placed the support 22 in a closer-to position relative to the toilet 1. However, in FIG. 7B, the technician "t" has placed the support 22 in a farther-from position relative to the toilet 1. Accordingly, extension or retraction of the front-facing portion 20 can advantageously place the support 20 in a desired position. The cover 10 is advantageously configured in this manner because the front-facing portion 14 has a suitable length for extension and because the front-facing portion 14 is not attached to each side-facing portion 14 except through attachment by the top portion 16. This additionally makes the cover 10 suitable for toilets of varying dimensions. Additionally, while the drawings illustrate a toilet typically found in commercial settings, the one or more inventions disclosed herein are not so limited and may be applied or used with any toilet including those for residential use.

While the embodiments have been described in connection with the preferred embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed:

1. A cover for a toilet having a base and a bowl, the cover comprising:

a sheet for covering the exterior surfaces of the bowl and the base of the toilet, the sheet having side-facing portions and a front-facing portion, the front-facing portion having a length that extends from the bowl to a nearby floor surface, wherein the front-facing portion is not attached to the side-facing portions along said length; and a cushion carried on about a proximal end of the front-facing portion of the sheet for providing cushioning support to a technician during servicing of the toilet.

2. The cover of claim 1, further including anti-slip material on a floor-engaging portion of the sheet for reducing slip of the cover during use.

3. The cover of claim 1, further including a strap that extends from opposing surfaces of the sheet and around a back-facing portion of the bowl for fixedly engaging the cover to the toilet.

4. The cover of claim 1, wherein the sheet is water-impermeable.

5. The cover of claim 1, wherein the sheet is flexible.

6. The cover of claim 1, further including indicia on a portion of the cover, the indicia for providing an indication of the operability of the toilet.

7. The cover of claim 1, wherein the cover further comprises a pocket on an upward-facing portion thereof configured for receiving a sheet having indicia printed thereon for providing an indication of the operability of the toilet.

8. The cover of claim 1, wherein the cushion comprises one of plastic, cotton, granular material, and combinations thereof.

9. A cover for a toilet having a base and a bowl, the cover comprising:

a sheet having side-facing portions that extend from a top portion and are configured to extend to a ground surface for covering the bowl and base of the toilet, and a front-facing portion that extends from the top portion independently of the side-facing portions and is configured to extend to a ground surface spaced-frontwardly from the toilet; and a support carried on about a proximal end of the front-facing portion for providing support to a technician during servicing of the toilet.

10. The cover of claim 9, further including anti-slip material on a floor-engaging portion of the sheet for reducing slip of the cover during use.

11. The cover of claim 9, further including a strap that extends from opposing surfaces of the sheet and around a back-facing portion of the bowl for fixedly engaging the cover to the toilet.

12. The cover of claim 9, wherein the sheet is water-impermeable.

13. The cover of claim 9, wherein the sheet is flexible.

14. The cover of claim 9, further including indicia on a portion of the cover, the indicia for providing an indication of the operability of the toilet.

15. The cover of claim 9, wherein the cover further comprises a pocket on an upward-facing surface of the top portion and is configured for receiving a sheet having indicia printed thereon for providing an indication of the operability of the toilet.

16. The cover of claim 9, wherein the support comprises a cushion.

17. The cover of claim 16, wherein the cushion comprises one of plastic, cotton, granular material, and combinations thereof.

18. A cover for a toilet having a bowl and a base, the cover comprising:

a sheet having side-facing portions that extend from a top portion and are configured to extend to a ground surface for covering the bowl and base of the toilet, and further having a front-facing portion not in attachment with either of the side-facing portions and that extends from the top portion and is configured to extend to a ground surface spaced-frontwardly from the toilet; and a support defined on about a proximal end of the front-facing portion for providing support to a technician during servicing of the toilet, wherein placement of the support is adjustable by extension or retraction of the front-facing portion.

19. The cover of claim 18, wherein the cover further comprises a pocket on an upward-facing portion thereof configured for receiving a sheet having indicia printed thereon for providing an indication of the operability of the toilet.

20. The cover of claim 18, further including anti-slip material on a floor-engaging portion of the sheet for reducing slip of the cover during use.

* * * * *